United States Patent [19]

Badesha et al.

[11] 4,448,646

[45] May 15, 1984

[54] PROCESS FOR PREPARATION OF HIGH PURITY METALS BY THE ELECTROCHEMICAL REDUCTION OF CHALCOGENIDE ESTERS

[75] Inventors: Santokh S. Badesha, Ontario, N.Y.; Rafik O. Loutfy, Willowdale, Canada

[73] Assignee: Xerox Corporation, Stamford, Conn.

[21] Appl. No.: 509,752

[22] Filed: Jun. 30, 1983

[51] Int. Cl.[3] ..... C25C 1/22

[52] U.S. Cl. ..... 204/59 M; 204/59 R

[58] Field of Search ..... 204/59 R, 59 M

[56] References Cited

FOREIGN PATENT DOCUMENTS 681442 3/1964 Canada ..... 204/59 M 1127159 9/1968 United Kingdom ..... 204/59 M

*Primary Examiner*—R. L. Andrews

*Attorney, Agent, or Firm*—E. O. Palazzo

[57] ABSTRACT

This invention is directed to a process for preparing metallic elements of high purity which comprises providing the corresponding esters of the elements desired dissolved in an organic medium, and an organic salt, and subsequently subjecting the resulting solution to an electrochemical reduction in an electrolytic apparatus.

6 Claims, No Drawings

PROCESS FOR PREPARATION OF HIGH PURITY METALS BY THE ELECTROCHEMICAL REDUCTION OF CHALCOGENIDE ESTERS

BACKGROUND OF THE INVENTION

This invention is generally directed to processes for the preparation of metals, and more specifically the present invention is directed to an improved process for preparing high purity selenium, sulfur, tellurium, and arsenic, by subjecting the corresponding esters to an electrochemical reduction in the presence of an organic media. In one embodiment of the present invention, for example, selenium and tellurium in a purity of 99.99 percent are obtained by subjecting the corresponding pure selenium ester, or pure tellurium ester to an electrochemical reduction in the presence of an organic composition. The resulting high purity metals, particularly selenium, tellurium and arsenic, prepared in accordance with the process of the present invention are useful as photoconductive imaging members, in electrostatographic imaging systems.

The art of xerography as presently practiced, involves the formation of an electrostatic latent image on a photoconductive imaging member which can be in the form of a plate, a drum, or a flexible belt, for example. Materials commonly selected for the photoconductive member contain amorphous selenium, amorphous selenium alloys, halogen doped amorphous selenium compositions, halogen doped amorphous selenium alloys, and the like. These photoconductive members must generally be of high purity, that is, a purity of 99.99 percent or greater, since the presence of contaminants has a tendency to adversely affect the imaging properties of the members, including the electrical properties thereof, causing copy quality to be relatively poor as compared to devices wherein high purity substances are selected.

Numerous complex processes are known for obtaining photoconductive substances, such as selenium, or alloys of selenium, these processes generally being classified as chemical processes, and physical processes. These prior art processes, including the chemical process for obtaining high purity metals involve a number of process steps and undesirably high temperature distillations. Additionally, in many of these processes recycling of the reactants is not achieved. Also, in many instances the prior art processes for recovering selenium, selenium alloys, or other metallic elements from contaminated source materials is complex, economically unattractive, causes environmental contamination in that, for example, various vaporous oxides are formed, and must be eliminated. Furthermore, many of these processes result, for example, in the recovery of selenium or selenium alloys which nevertheless contain impurities that can over an extended period of time adversely affect their photoconductivity. Moreover, flexible photoreceptor devices containing photoconductive compositions prepared in accordance with these processes have a tendency to deteriorate over a period of time and, thus, the selenium or seleniumm alloy used, for example, must be recovered and recycled. Various methods are available for recovering the selenium from the substrate on which it is deposited including heat stripping, water quenching, ultrasonics, and bead blasting.

There is disclosed in U.S. Pat. Nos. 4,007,255 and 4,009,249 the preparation of stable red amorphous selenium containing thallium, and the preparation of red amorphous selenium. In the '255 patent there is disclosed a process for producing an amorphous red selenium material containing thallium, which comprises precipitating selenous acid containing from about 10 parts per million to about 10,000 parts per million of thallium dioxide, with hydrazine, from a solution thereof in methanol or ethanol, containing not more than about 50 percent by weight of water, at a temperature of between about −20 degrees centrigrade, and the freezing point of the solution, and maintaining the resulting precipitate at a temperature of from about −13 degrees Centigrade to about −3 degrees centigrade until the solution turns to a red color. The '249 patent contains a similar disclosure with the exception that thallium is not contained in the material being treated.

In addition to the above described methods for preparing selenium, there are known a number of other processes for obtaining selenium and selenium alloys. Thus, for example, there is disclosed in U.S. Pat. No. 4,121,981 an electrochemical method for obtaining a photoreceptor comprised of a selenium tellurium layer. More specifically there is described in this patent the formation of a photogenerating layer by electrochemically codepositing selenium and tellurium onto a substrate from a solution of their ions in such a manner than the relative amounts of selenium and tellurium which are deposited are controlled by their relative concentrations in the electrolyte, and by the choice of electrochemical conditions. Moreover, there is disclosed in U.S. Pat. No. 4,192,721 the preparation of metal chalcogenides by depositing these materials on a cathode as a smooth film by an electroplating process accomplished at low current densities wherein there is selected a metal salt electrolyte dissolved in an organic polar solvent, and in which is also dissolved the chalcogen in elemental form, with the electrolytic bath being maintained at elevated temperatures.

Further, there is disclosed in U.S. Pat. No. 2,649,409, the electrodeposition of selenium on conducting surfaces. According to the disclosure of this patent selenium may be electrodeposited in its grey metallic form by utilizing an electrodeposition bath containing a supply of quadrivalent selenium cations, that is, cations containing selenium in the quadrivalent state such $Se^{+4}$, $SeO^{+2}$. Similarly, there is disclosed in U.S. Pat. No. 2,649,410 the manufacturing of selenium rectifiers, selenium photocells, and similar devices wherein grey crystalline metallic selenium is electrodeposited on a cathode from an acidic aqueous solutions of selenium dioxide. More specifically, in the process described in this patent elemental particles of selenium are added to an aqueous acidic solution containing selenium dioxide, the selenium particles being added in a quantity greater than the normal metallic selenium content of the solution, followed by accomplishing an electrodeposition of the resulting treated solution.

Recently, there has been developed processes for preparing selenium and tellurium in high purity wherein the corresponding isolated substantially pure esters are subjected to a reduction reaction with hydrazine or sulfur dioxide, resulting in a product having a purity of 99.999 percent. The details of these processes are described in copending applications, U.S. Ser. No. 404,259, and U.S. Pat. No. 404,257, the disclosure of each being totally incorporated herein by reference.

While the process as described in the copending applications are suitable for the purposes intended, there continues to be a need for other processes for preparing metals such as selenium of high purity. Furthermore, there continues to be a need for improved processes for preparing selenium, tellurium, and arsenic of high purity, 99.99 percent or greater, wherein the electrical properties of the resulting product can be controlled. Additionally, there continues to be a need for processes for obtaining selenium and tellurium in high purity, wherein the reduction of the corresponding pure esters is not accomplished by chemical means, and where there can be obtained products with extended hole transporting properties, and extended electron transporting properties. Moreover, there continues to be a need for the preparation of metals in high purity by subjecting the corresponding pure esters to an electrochemical reduction reaction. Also, there continues to be a need for the preparation of photoconductive materials of high purity by subjecting the corresponding substantially pure metallic esters to an electrochemical reduction in a non-aqueous media.

OBJECTS OF THE INVENTION

It is an object of the present invention to provide processes for preparing metals of high purity, which overcome some of the above-noted disadvantages.

In another object of the present invention there are provided improved processes for preparing metals of high purity by subjecting the corresponding metallic esters to an electrochemical reduction reaction.

In a further object of the present invention there are provided improved processes for the preparation of selenium of high purity and in relatively high yields by electrochemically reducing the corresponding pure selenium ester in the presence of an organic composition.

An additional object of the present invention resides in the provision of an improved process for the preparation of tellurium of high purity, and in relatively high yields, by subjecting the corresponding pure tellurium ester to an electrochemical reduction reaction in the presence of an organic composition.

In yet another object of the present invention there are provided improved processes for obtaining high purity, selenium and tellurium, wherein essentially no pollutants are emitted, and complex and expensive high temperature heating apparatuses, such as quartz are not needed.

In yet a further object of the present invention there are provided improved processes for obtaining high purity selenium, high purity tellurium, and high purity arsenic, with consistent and improved electrical properties, wherein the corresponding pure metallic esters are subjected to an electrochemical reduction.

These and other objects of the present invention are accomplished by the provision of an improved process for the preparation of metals of high purity by the electrochemical reduction of the corresponding pure esters. More specifically, in accordance with the present invention, there is provided improved processes for preparing metals such as selenium, tellurium and arsenic of high purity, 99.99 percent or greater, by subjecting the corresponding pure metallic esters to an electrochemical reduction reaction in the presence of an organic composition and an organic acid. In one variation of the process of the present invention with respect to the preparation of high purity selenium, selenous acid, selenium oxide, or mixtures thereof are obtained from the reaction of crude selenium with a strong acid such as nitric acid or sulfuric acid. Subsequently, the selenium oxides are reacted with an alcohol, followed by subjecting the resulting isolated selenium ester to an electrochemical reduction reaction in the presence of an organic media, and an organic acid.

In another variation of the process of the present invention, there is prepared tellurium of high purity which comprises reacting tellurium dioxide with a glycol, or tellurium tetrachloride with an alkoxide (sodium ethoxide) and the corresponding alcohol (ethanol) followed by subjecting the resulting separated esters, subsequent to purification by, for example, distillation or crystallization, to an electrochemical reduction in the presence of an organic media, and an organic acid.

DESCRIPTION OF THE PREFERRED EMBODIMENTS

The process of the present invention will now be described with reference to the following illustrative preferred embodiments, however, process conditions, parameters, and reactants other than those specified can be selected providing the objectives of the present invention are achieved. Accordingly, it is not intended to be limited to the reactants, process conditions, electrochemical reaction conditions, and the like that follow.

Prior to accomplishing the electrochemical reduction in accordance with the process of the present invention, there is initially prepared the substantially pure corresponding metallic esters. Thus, for example, the liquid dialkyl selenite ester, of the formula $(RO)_2$ SeO, wherein R is an alkyl group, is prepared, for example, by a reacting selenous acid with an aliphatic alcohol. The resulting selenite ester subsequent to separation from the reaction mixture is further purified by distillation, and then subjected to an electrochemical reduction reaction, wherein selenium of high purity, and in high yield is obtained. In a variation of this process, the selenous acid, selenium oxides, and mixtures thereof are obtained by dissolving crude selenium, in strong acids such as nitric acid, sulfuric acid, or mixtures thereof.

The aliphatic alcohol selected for the formulation of the ester is generally of the formula ROH, wherein R is an alkyl group containing from 1 to about 30 carbon atoms, and preferably from 1 to about 6 carbon atoms. Illustrative examples of preferred R groupings for the aliphatic alcohol, and the selenite ester include methyl, ethyl, propyl, butyl, pentyl, and hexyl, with methyl and ethyl being preferred. Specific preferred alcohols selected include methanol, ethanol and propanol.

In another important variation of this process there can be selected for formation of the ester a diol instead of an aliphatic alcohol. The diol selected is generally of the formula $HO(CR_1R_2)_nOH$ wherein $R_1$ and $R_2$ are hydrogen, or alkyl groups as defined herein, and n is a number of from 1 to about 10. Examples of preferred diols that may be selected include ethylene glycol, and propylene glycol.

The selenium esters resulting from the diol reaction are of the general formula:

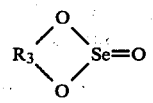

wherein $R_3$ is an alkylene group, such as methylene, ethylene, propylene, and the like.

In one specific illustrated process embodiment, the selenium ester is obtained by oxidizing a crude selenium material available from Fisher Scientific Company, to its corresponding oxides by dissolving this material in a strong acid. As strong acids, there can be selected commercially available concentrated nitric acid, commercially available concentrated sulfuric acid, or mixtures thereof. When mixtures of acids are utilized, generally from 20 percent of sulfuric acid and about 80 percent of nitric acid are selected, however, percentage mixtures can range from between about 5 percent sulfuric acid to about 95 percent nitric acid, and preferably from about 10 percent sulfuric acid to about 90 percent nitric acid. The preferred acid is nitric acid, primarily since it is a stronger oxidizing acid for selenium. Other chemical oxidizing reagents such as hydrogen peroxide, molecular oxygen, and the like, can also be used to effect this conversion. Generally the crude material is about 98 percent pure, and contains a number of impurities, such as arsenic, bismuth, cadmium, chromium, iron, sodium, magnesium, lead, antimony, tin, silicon, titanium, nickel, lead, thallium, boron, barium, mercury, zinc, other metallic and non-metallic impurities, and the like.

The amount of crude selenium to be dissolved can vary depending, for example, on the amount of high purity product desired. Normally from about 1 pound to about 1.5 pounds of crude selenium are dissolved, and preferably from about 1 pound to about 500 grams are dissolved, however, it is to be appreciated that substantially any appropriate, but effective amount of crude selenium can be dissolved, if desired.

Generally, the acid used for dissolving the crude selenium product is added thereto in an amount of from about 600 milliliters to about 1,200 milliters, for each pound of selenium being dissolved, and preferably from about 800 milliliters to about 900 milliliters.

The resulting suspension of selenium and acid are stirred at a sufficient temperature so as to cause complete dissolution of the crude selenium. In one specific embodiment, the suspension is continuously stirred at a temperature of between about 65 degrees centigrade to about 85 degrees centigrade for a sufficient period of time to cause complete dissolution of the crude selenium, as noted by the formation of a clear solution. This solution is usually formed in about 1 hour to about 3 hours, however, the time can vary significantly depending on the process parameters selected. Thus, for example, very extensive stirring at higher temperatures will result in complete dissolving of the crude selenium in about an hour or less, while low temperatures, less than 30 degrees centigrade, and slow stirring will not cause the crude selenium to be dissolved until about 3 hours or longer.

Thereafter, the concentrated acid mixture is separated from the resulting clear solution by a number of known methods including distillation at the appropriate temperature, for example, 110 degrees Centigrade when nitric acid is being separated. The resulting separated acid can be collected in a suitable container, such as a distillation receiver, and subsequently recycled and repeatedly used for dissolving the crude selenium product.

Subsequent to the distillation reaction, and separation of the acid from the solution mixture, there results a white powder, identified as selenous acid $H_2SeO_3$, and other oxides of selenium, such as selenium dioxide. To this powder there is then added an aliphatic alcohol of the formula ROH, wherein R is an alkyl group containing from 1 to about 30 carbon atoms, and preferably from 1 to about 6 carbon atoms, or a diol, causing the formation of a liquid selenium ester. Generally, from about 500 milliliters to about 800 milliliters, and preferably from about 600 milliliters to about 700 milliliters of aliphatic alcohol, or diol, are utilized for conversion to the selenium ester, however, other appropriate amounts can be selected.

Water formed subsequent to the addition of the aliphatic alcohol or diol, can be removed if desired by an azeotropic distillation process. This is accomplished by boiling the mixture with various azeotropic substances, such as aliphatic and aromatic hydrocarbons including toluene, benzene and pentane. The known azeotropic distillation processes can be effected at temperatures at which the azeotropic agent begins to boil, thus when pentane is used this temperature ranges from about 30 degrees centigrade to about 35 degrees centigrade. While it is not necessary to azetropically remove water from the reaction mixture, since the purity of the resulting selenium product will not be adversely affected, it is preferred in the process of the present invention to cause this removal in order, for example, that higher yields of product might be obtained.

The complete removal of water, and thus total conversion to the selenium ester is generally accomplished in a period of from about 8 to about 10 hours.

The excess aliphatic alcohol and hydrocarbons, if any, selected for the azeotropic distillation, are then removed by subjecting the resulting reaction mixture to distillation, generally under a vacuum of about 5 millimeters of mercury, at a temperature of from about 70 degrees centigrade to about 80 degrees centigrade. There is then collected, when ethanol is the alcohol selected a pure, 99.99 percent or greater, colorless liquid selenium ester diethyl selenite $(C_2H_5)_2SeO$, as identified by spectroscopic analysis, however, other dialkyl selenite esters can also be obtained with different alcohols.

This pure isolated dialkyl selenite ester is then directly electrochemically reduced in an electrolytic cell containing an organic composition and an organic acid, to selenium of a purity of 99.99 percent as detailed hereinafter.

With regard to the preparation of the high purity tellurium ester, there is initially dissolved in a strong acid, such as concentrated nitric acid commercial grade tellurium containing contaminants, or crude tellurium resulting in a solution of tellurium oxides, which are then reacted with a glycol. The tellurium material to be treated which is available from numerous sources, including Fisher Scientific Company, has a purity level of only about 99.5 percent, since it contains a number of contaminants including, arsenic, silver, aluminum, boron, barium, calcium, cadmium, cobalt, chromium, copper, iron, mercury, sodium, magnesium, maganese, molybdenum, nickel, lead, antimony, tin, silicon, titanium, thallium, and zinc. These impurities are removed in accordance with the process of the present invention, resulting in a tellurium material having a purity of 99.99 percent or higher.

As strong acids there can be selected commercially available concentrated nitric acid, commercially available concentrated sulfuric acid, and mixtures thereof. When mixtures of acids are selected generally from about 20 percent of sulfuric acid and about 80 percent of nitric acid are used, however, percentage mixtures can range from between about 5 percent sulfuric acid to about 95 percent nitric acid, and preferably from about 10 percent of sulfuric acid to about 90 percent of nitric acid. The preferred acid is nitric acid, primarily since it is a strong oxidizing acid for the tellurium.

Generally, the strong acid such as nitric acid used for dissolving the crude tellurium product is added thereto in an amount of from about 600 milliliters to about 1,200 milliliters, for each pound of tellurium being dissolved, and preferably from about 800 milliliters to about 900 milliliters.

The resulting suspension of tellurium and acid are stirred at sufficient temperature so as to cause complete dissolution of the crude tellurium. In one specific embodiment, the suspension is subjected to extensive stirring; and the mixture is heated to a temperature not exceeding 110 degrees centigrade, for a sufficient period of time until complete dissolution occurs. Generally, the crude tellurium will be completely dissolved in a period of from about 6 hours to about 10 hours. The unreacted nitric acid can then be removed from the reaction mixture collected in a receiver, and recycled for subsequent use.

Subsequently, the tellurium oxide obtained is reacted with a glycol in the presence of a catalyst such as para-toluene sulfonic acid, wherein there results a tetraalkoxytellurane ester. The amount of glycol and catalyst such as para-toluene sulfonic acid selected is dependent on a number of factors including the amount of tellurium oxide formed. Generally, however, from about 1 to about 3 liters of glycol, and from about 5 to about 10 grams of catalyst, such as para-toluene sulfonic acid are used, for each pound of tellurium oxide being treated.

Other catalysts can be selected for assisting in the reaction of the tellurium oxide with a glycol, such catalysts including aliphatic and aromatic sulfonic acids, other than para-toluene sulfonic acid, mineral acids, such as sulfuric acid, acetic acid, hydrochloric acid, and the like. Additionally, other similar equivalent catalysts can be utilized providing the objectives of the present invention are achieved.

Numerous known suitable glycols including aliphatic and aromatic diols, can be selected for reaction with the tellurium oxide for the purpose of forming the tellurium ester. Examples of aliphatic diols include those of the following formula:

$$HO(CR_1R_2)_nOH$$

wherein $R_1$, and $R_2$ are independently selected from hydrogen, or alkyl groups containing from 1 carbon atom to about 30 carbon atoms, and preferably from about 1 carbon atom to about 6 carbon atoms, and n is a number of from about 1 to about 10, and preferably from about 1 to about 5.

Illustrative examples of aromatic diols include those of the following formula:

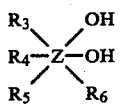

wherein $R_3$, $R_4$, $R_5$, and $R_6$ are independently selected from the group consisting of hydrogen and alkyl groups containing from about 1 to about 30 carbon atoms, and preferably from about 1 to about 6 carbon atoms, and Z is an aromatic ring containing from about 6 carbon atoms to about 24 carbon atoms, such as benzene, and the like.

The alkyl substiuents for $R_1$, $R_2$, $R_3$, $R_4$, $R_5$, and $R_6$ include those generally known such as methyl, ethyl, propyl, butyl, pentyl, hexyl, and the like, with methyl, ethyl, and propyl being preferred.

Specific illustrative examples of aliphatic and aromatic glycols that may be selected include ethylene glycol, 1,2-propylene glycol, 1,3-propylene glycol, 1,3-pentamethylene glycol, pinacol, 1,2-benzene diols, 1,3-benzene diols, naphthalene diols, and the like, with ethylene glycol being preferred.

Thereafter, the tetralkoxytellurane esters are separated as solids, which can be purified by recrystallization, or as liquids, wherein purification is accomplished by distillation. The isolated pure ester is then subjected to an electrochemical reduction reaction as disclosed herein.

As an optional step in the process for the preparation of the tellurium ester, any water formed by the reaction of the tellurium oxides with the glycol can be azeotropically removed by distillation with various aliphatic, and aromatic azeotropic agents such as pentane, cyclohexane, toluene and benzene. The temperature of the azeotropic reaction will vary depending on the azeotropic material selected, thus for toluene, the azeotropic distillation is accomplished at a temperature of from 34 degrees centigrade to about 95 degrees centigrade, while for benzene the temperature used is from about 60 degrees centigrade to about 68 degrees centigrade. Generally, complete removal of water occurs in about 8 to about 10 hours, thus allowing substantially complete conversion of the tellurium oxide to the corresponding tellurium ester, tetraalkoxytellurane $Te(OCH_2O)_2$. It is not necessary to remove water from the reaction mixture since the purity of the resulting tellurium substance will not be adversely affected, however, it is believed that higher yields of tellurium will be obtained with the removal of water, although this may not necessarily be the situation under all reaction conditions.

The tetraalkoxytelluranes esters can also be prepared by the condensation of tellurium tetrachloride, with alcohols in the presence of the corresponding alkoxides, such as sodium methoxide, sodium ethoxide, and the like. The tetraalkoxytelluranes prepared by this method are represented by the following general formula:

$$(RO)_4Te$$

wherein R is an alkyl group as defined hereinbefore.

Illustrative examples of alcohols that can be selected for reaction with tellurium tetrachloride include those of the formula ROH, wherein R is an alkyl group containing from 1 to about 30 carbon atoms and preferably from 1 to about 6 carbon atoms. Specific examples of alcohols that may be selected include methanol, ethanol, propanol, and the like.

The high purity arsenic ester is prepared in substantially the same manner described herein with regard to preparation of the tellurium ester, thus for example, the arsenic ester, bis(arsenic triglycollate) of the formula $$(OCH_2)_2As—O—CH_2CH_2O—As(OCH_2)_2$$

can be prepared by treating arsenic oxide ($As_2O_3$), with ethylene glycol in the presence of a catalyst such as p-toluene sulfonic acid. Other arsenic esters may also be selected for the process of the present invention including arsenic alkoxides of the general formula $As(OR)_3$ wherein R is as defined herein. The arsenic alkoxides are generally prepared by reacting arsenic trichloride with sodium alkoxides in the presence of the corresponding alcohols. For example, such a reaction is illustrated by the following equation:

$$AsCl_3 + ROH \xrightarrow{NaOR} As(OR)_3$$

The resulting arsenic esters are soluble in organic solvents such as cellosolve and thus can be easily coreduced to metallic arsenic with a reducing agent such as hydrazine.

Similarly, the corresponding sulfur ester diallyl sulfite which is commercially available can be prepared by the reaction of thionyl chloride with an alcohol. For example, dimethyl sulfide, can be prepared by the condensation reaction of thionyl chloride with methanol in accordance with the following equation:

$$SOCl_2 + CH_3OH \rightarrow (CH_3O)_2SO$$

The electrochemical reduction reaction is then accomplished in a known electrolytic apparatus containing an anode, a cathode, a power source for the apparatus, and an electrolytic solution containing the pure ester in an organic media, and an organic salt. The reduction reaction occurring in the electrolytic apparatus is illustrated with reference to the following equations:

$$(RO)_2XO \xrightarrow[\text{slow; rate determining}]{e} (RO)_2XO- \quad \text{I.}$$

$$(RO)_2XO \xrightarrow[\text{instantaneous}]{-3e + 4H^+} 2ROH + H_2O + X\downarrow \quad \text{II.}$$

wherein X is selenium, sulfur, tellurium, or arsenic.

The electrochemical reduction reaction generally occurs at various current densities, however in one embodiment this density is from about 0.1 amps, to about 2 amps per centimeter squared, however, other current densities can be selected providing the objectives of the present invention are achieved.

Various known anode materials can be selected for use in the process of the present invention, including carbon, graphite, gold, platinum, steel, nickel, titanium, ruthenized titanium, indium/tin oxides, and the like. Other anode materials can be selected providing, for example, that they do not dissolve substantially in the electrolytic solution.

Illustrative examples of useful cathode materials include indium/tin oxides, tin oxides, carbon, steel, nickel, titanium, noble metals such as gold, platinum, palladium, chromium, ruthenized titanium, and the like. Furthermore, cathode materials which contain various substrates, such as plastic sheets, webs, or aluminum drums, coated with the aforementioned metals, expecially chromium or titanium coated aluminum sheets or drums can be selected.

The electrolytic solution selected for the electrochemical apparatus or electrochemical cell is comprised of various known organic solvents, such as cellosolve, glycols, glymes, dimethylsulfoxide, dimethylformamide, acetonitrite, propylene carbonate, and various other known electrochemical solvents. Additionally, incorporated into the solution are known electrolytic organic salts, such as tetraalkylammonium salts, including tetraethyl ammonium salts, tetrabutyl ammonium perchlorate, tetrafluoroborates, and the like, wherein the alkyl groups contain from about 2 carbon atoms to about 7 carbon atoms. Other electrolytic solvent salts such as ammonium chloride, and lithium chloride, can be incorporated into the electrolytic solution. The ester to be reduced in accordance with the process of the present invention is dissolved in the solution mixture of organic solvent, and organic salt.

Subsequent to completion of the electrochemical reduction reaction, the pure metal contained in the ester is deposited at the cathode of the electrochemical cell, while there is formed at the anode unidentified oxidation products. The amount of metal deposited depends on a number of factors including the current density selected and the time of deposition, for example. Generally, the amount of pure metal deposited at the cathode is from about 0.01 microns per minute to about 0.5 microns per minute. When there is achieved a thickness of from about 0.1 micron to about 100 microns, and preferably from about 1 micron to about 10 microns as determined, for example, by optical microscopic measurements, the cathode is removed from the electrochemical cell and the metal deposited thereon is recovered by scrapping with a metal rod, followed for example, by washing with water, methenol, and acetone.

In one embodiment, the cathode contained in the electrochemical cell can be comprised of substrate materials that can be incorporated into photoresponsive imaging devices. Specifically, the cathode can be comprised of aluminum, upon which there is deposited the pure metal, followed by removal of the cathode from the electrolytic cell, cleaning by washing with water, and incorporating the resulting member, as a photoconductive imaging surface in an electrostatographic imaging apparatus.

The electrolytic bath is generally maintained at a temperature of from about 15 degrees centigrade, to about 80 degrees centigrade, and preferably at a temperature of from about 40 degrees centigrade to about 60 degrees centigrade.

Generally, the cathode, anode, and electrolytic bath are contained in a steel chamber. Additionally, a power source is used for the purpose of supplying the appropriate current to the electrolytic cell for initiating and maintaining the electrochemical reduction reaction.

The identity and purity of the isolated pure esters was determined by a number of known methods including infrared, (NMR) ultraviolet, and confirmed by elemental and mass spectral analysis, while the purity of the resulting electrodeposited metal products, such as selenium, tellurium, and arsenic obtained by the electrochemical reduction of the corresponding pure esters was determined by emision spectroscopy, and x-ray deffraction.

The high purity substances obtained in accordance with the reduction process of the present invention, including the high purity selenium, high purity tellurium, and high purity arsenic, can be selected for use as photoconductive imaging members in electrostatographic imaging systems. Thus, for example, selenium of a 99.95 percent purity obtained in accordance with the electrochemical reduction process of the present invention can be selected, or the selenium can be combined with high purity arsenic, or high purity tellurium for selection as a photoconductive imaging member.

These alloys generally contain a substantial amount of selenium, for example, from about 75 percent by weight or more, thus alloys comprised of from about 75 percent by weight to about 95 percent by weight of selenium, and from about 5 percent by weight to about 25 percent by weight of tellurium are preferred. Additionally, alloys containing from about 95 percent by weight to about 99.9 percent by weight of selenium, and from about 5 percent by weight to about 0.5 percent by weight of arsenic can be used. Generally, however, numerous various alloys of any proportions can be selected as the photoconductive imaging member wherein the elements of the alloy are purified in accordance with the electrochemical reduction process of the present invention. Examples of other alloys, include selenium antimony, selenium cadmium, and the like.

The following examples specifically defining preferred embodiments of the present invention are now provided, which examples are not intended to limit the scope of the present invention, it being noted that various alternative parameters which are not mentioned are included within the scope of the present invention. Parts and percentages are by weight unless otherwise indicated. In the examples, the identity and purity of the isolated esters was determined by infrared, mass spectroscopy, ultraviolet analysis, and elemental analysis, while the purity of the metallic products, such as selenium, or tellurium, was determined by emision spectroscopy.

EXAMPLE I

This example describes the preparation of diethyl selenide from a crude selenium source material, by first converting the crude selenium to selenous acid by treatment with nitric acid, followed by a condensation reaction with an alcohol, wherein there results a dialkyl selenite as identified by infrared, nuclear magnetic resonance (NMR), mass spectroscopy, and elemental analysis for hydrogen, oxygen, and carbon.

One pound of crude selenium powder was dissolved in 1 liter of concentrated nitric acid by stirring and warming over a period of 3 hours in a 2-liter round bottom (RB) flask. After a clear solution was obtained, nitric acid was distilled off at a temperature of 110–112 degrees centigrade, and the remaining traces of nitric acid were then removed under high vacuum. The resulting white residue was dissolved in 700 milliliters of absolute ethanol, and any water formed was removed azeotropically with 600 milliliters of benzene. The azeotropic distillation was completed in about 15 hours. There was then removed by vacuum distillation, at standard pressures, benzene and excess ethanol, and the resulting residue was fractionally distilled under high vacuum. Pure diethyl selenite which boils at 65 degrees Centigrade/3 mm was collected. The grey residue left in the flask was dissolved in absolute ethanol (800 ml) and benzene (600 ml). Any water formed was removed azeotropically and an additional crop of diethyl selenite was obtained. The total, yield of diethyl selenite was 90 percent, (956 grams). This yield can be increased further by recycling the grey residue remaining in the flask.

EXAMPLE II

This example describes the conversion of commercial grade selenous acid (94 percent) into diethyl selenite.

A mixture of selenous acid (100 grams), absolute ethanol (200 ml) and benzene (200 ml) was charged to a 1 liter RB flask equipped with a Dean-Stark refluxing column. This mixture was stirred at room temperature under an atmosphere of argon until a clear solution was obtained. The reaction mixture was then slowly refluxed and the water removed azeotropically. About 7 hours were required to complete the reaction to this point. Excess ethanol and benzene are removed by distillation, and the resulting grey residue was distilled under reduced pressure. There was collected 89 grams of a colorless liquid distilling at 68 degrees Centigrade/5 mm. The grey solid residue was again dissolved in a mixture of ethanol (100 ml) and benzene (150 ml). The water was removed azeotropically, and after removing excess ethanol and benzene the residue was fractionally distilled. The fraction distilling at 68 degrees Centigrade/5 mm was collected, and identified as pure diethyl selenite, by infrared, nuclear magnetic resonance (NMR), and confirmed by elemental analysis for carbon, oxygen, and hydrogen, The amount of this fraction was 33 grams, thereby increasing the overall yield of diethyl selenite to 122 grams (91 percent).

EXAMPLE III

This example describes the conversion of selenium dioxide into dimethyl selenite.

A mixture of selenium dioxide (50 grams), p-toluene sulfonic acid (5 grams) in 500 milliliters of methanol was charged to a 1 liter RB flask fitted with a Dean-Stark apparatus. The reaction mixture was refluxed and stirred on a magnetic stirrer for 5 hours during which time a clear solution results. Chloroform (200 ml) was then added to the reaction flask and water removed azeotropically. Excess methanol and chloroform was removed by distillation, and the residue in the flask was then distilled under high vacuum. Pure dimethyl selenite, as identified by infrared, nuclear magnetic resonance (NMR), mass spectroscopy, and elemental analysis for carbon, hydrogen, and oxygen, and which distills at 43 degrees Centigrade/5 mm of mercury was collected. A total yield of 60 grams (85 percent) of this ester was collected.

EXAMPLE IV

A mixture of commercial grade tellurium dioxide (160 grams), p-toluene sulfonic acid (5 grams) and ethylene glycol (1,600 ml) was charged into a 2-liter round bottom (RB) flask equipped with a reflux condenser. The contents of the flask were heated and stirred under an argon atmosphere at 120 degrees centigrade for 3 hours, and then at 160 degrees centigrade until a clear solution was obtained, about 10 to 15 minutes. The above solution was allowed to cool to room temperature and then allowed to stand on a bench for 5 hours. Tetraalkoxytellurane, which separated out as white needles, was collected by filtration, washed with 100 milliliters (2×50 ml) of cellusolve and recrystallized from cellosolve, and identified by infrared, NMR, mass spectral analysis and elemental analysis for carbon, hydrogen, oxygen and tellurium. The overall yield of the ester was 215 grams or 86 percent. The filtrates were discarded. An additional amount of tetraethoxytellurane can be obtained by concentrating the above filtrates.

EXAMPLE V

In this example there is described the preparation of tetraalkoxytellurane esters from commercial grade tellurium by first converting crude tellurium to tellurium dioxide followed by condensing the resulting dioxide, with ethylene glycol.

There was charged into a 1 liter round bottom flask (RB) equipped with a reflux condenser 300 milliliters of concentrated nitric acid followed by adding to the flask 50 grams of commercial grade tellurium. The resulting suspension was stirred and refluxed until the tellurium dissolves, and a white slurry was obtained. This conversion was generally completed in about 6 hours as noted by the formation of a white slurry of tellurium oxide. The unreacted nitric acid was then removed by distillation at a temperature of 110 degrees centigrade to 112 degrees Centigrade and any traces of nitric acid were removed under high vacuum. The white residue was identified as tellurium dioxide by spectroscopic analysis and analytical techniques.

The tellurium dioxide was then converted to a tetraalkoxytellurance ester by reacting 80 grams of the oxide with 500 milliliters of ethylene glycol and 5 grams of p-toluene sulfonic acid in accordance with the procedure as described in Example IV. The overall yield of tetraalkoxytellurance is 82.5 grams, or 84 percent yield.

A tetraalkoxytellurance of the formula

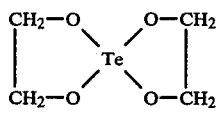

was obtained as confirmed by infrared, nuclear magnetic resonance, (NMR), mass spectral analysis, and elemental analysis for carbon, oxygen, hydrogen, and tellurium.

EXAMPLE VI

The diethylselenite prepared in accordance with the process of Example I was then subjected to an electrochemical reduction in the following manner:

There was placed in a 250 milliliter beaker 9.3 grams of the diethylselenite prepared in accordance with Example I, dissolved in 100 milliliters of the organic component cellosolve. To the resulting solution was added 2 grams of the salt tetrabutyl ammonium perchlorate and stirring was effected until this salt dissolved. Two electrodes, a graphite anode ($2\frac{1}{2}\times5$ cm), and a fine mesh ruthenized-titanium gride cathode ($3\times5$ cm), were immersed into the beaker solution. The solution was heated to 50 degrees centigrade. The two electrodes were then connected to a constant current power supply (Keithley 225 current source) and a current of 300 milliamps was passed through the solution causing the electroplating of selenium, in a thickness of 10 microns, in about 36 minutes, on the cathode. The resulting selenium deposits were scrapped off the cathode with a metal scraper, and collected. The selenium powder obtained was then filtered, washed with methanol, dried and distilled. Emission spectral analysis indicated the selenium was of a purity of 99.95 percent.

EXAMPLE VII

Pure tellurane was prepared by the electrochemical reduction of the tellurium ester as obtained from Example IV, in the following manner:

Into a 1000 milliliter electrolytic cell there was placed 20 grams of the tetraalkoxy tellurane ester, $(OCH_2CH_2O)_2$ Te, prepared in accordance with the process of Example IV, followed by adding thereto 500 milliliters of 2-ethoxyethanol (cellosolve). This mixture was then heated to 60–80 degrees centigrade with extensive stirring. Subsequently, a few drops of concentrated nitric acid were added to the mixture for the primary purpose of enhancing the solubility of the tellurium ester in the 2-ethoxyethanol. There was then added to the clear solution, 2 grams of the salt tetrabutyl ammonium perchlorate, followed by stirring until this salt was dissolved in the reaction mixture.

The electrolytic salt chamber was then equipped with 2 parallel electrodes, a stainless steel wire mesh cathode ($15\times10$ cm) and a solid ruthenized titanium anode ($15\times3$ cm). After immersing the cathode and partially into the solution, these electrodes were connected to an ECO 550 galvanostate. The solution was then electrolyzed by applying a current of 2,000 milliamps, the total charge passing through this solution being integrated by a ECO 721 integrator. The rate of charge flow was 120 coulombs per minute, and the solution was maintained at a temperature of about 50–70 degrees centigrade during electrolysis.

Gray metallic crystals of tellurium deposited on the cathode, and were collected and washed in accordance with the procedure of Example VI. There resulted a total of 4.25 grams of tellurium after a passage of 34,223 coulombs of charge in a period of 4.34 hours of electrolysis. Emission spectral analysis indicated that the resulting tellurium product had a purity of 99.95 percent.

EXAMPLE VIII

Tellurium of high purity was obtained by electrochemically reducing the tetraalkoxy tellurane ester as prepared in accordance with Example IV, the reduction being accomplished in the following manner:

There was placed in a 1,000 milliliter electrolytic cell, 10 grams of the tetraalkoxy tellurane, $(OCH_2CH_2O)_2$ Te, as prepared in accordance with Example IV, followed by the addition of 500 milliliters of dimethyl formamide, for the purpose of dissolving the tellurane. To the resulting solution there was then added 2 grams of the salt tetrabutyl ammonium perchlorate, which upon stirring dissolved in the solution mixture. The resulting solution was then electrolyzed by placing therein a stainless steel wire mesh cathode, and a graphite sheet anode, the electrolysis occurring at a current density of 2,000 milliamps, and a charge flow rate of 120 coulombs per minute, while maintaining the solution at a temperature of from about 40–60 degrees centigrade.

There was deposited on the cathode tellurium of gray to black in color, which after scrapping in accordance with the process of Example VI, was collected and washed with dimethyl formamide and methanol. There resulted 2.54 grams of pure tellurium, 99.99 percent pure, as determined by emission spectral analysis.

The total charge passed through the electrolytic cell was $2.55\times10^4$ coulombs.

EXAMPLE IX

The procedure of Example IX was repeated with the exception that there was added to the dimethyl formamide solution about 20 more grams of the tetra alkoxy tellurane ester prepared in accordance with Example IV. The solution was then electrolyzed at room temperature, about 25 degrees centigrade, at a current density of 2 amps. Pure crystalline gray tellurium electroplated at the stainless steel wire mesh cathode, a total of 3.56 grams being collected after a passage of 23,340 coulombs. Emission spectral analysis indicated that the resulting tellurium product had a purity of 99.999 percent.

High purity tellurium and selenium, 99.99 percent pure, can be prepared by repeating the above electrochemical reduction processes with the exception that other organic solvents can be selected in place of the cellosolve, including dimethylsulfoxide, propylene carbonate, 2-ethoxyethanol, glyme, and acetonitrile.

Other modifications of the present invention will occur to those skilled in the art based upon a reading of the disclosure of the present application, and these modifications are intended to be included within the scope of the present invention.

We claim:

1. A process for the preparation of selenium, tellurium, or arsenic of high purity, which comprises subjecting the following pure esters of these elements, which esters are of the formulas:

$$(C_2H_5O)_2SeO \quad \text{(I)}$$

$$Te(OCH_2CH_2O)_2 \quad \text{(II)}$$

$$(OCH_2)_2As—OCH_2CH_2O—As—(OCH_2)_2 \quad \text{(III)}$$

to an electrochemical reduction in an electrochemical apparatus, containing an anode, a cathode, a power source, and an electrolytic solution comprised of the esters contained in a solution of tetrabutyl ammonium perchlorate, and cellosolve, and wherein the temperature of the electrolytic solution is maintained at from about 15 degrees centigrade to about 80 degrees centigrade.

2. A process in accordance with claim 1 wherein the anode is comprised of graphite, carbon, gold, platinum, steel, nickel, titanium, or ruthenized titanium.

3. A process in accordance with claim 1 wherein the cathode is comprised of indium-tin oxides, tin oxides, carbon, steel, nickel, or ruthenized titanium.

4. A process in accordance with claim 1 wherein selenium of a purity of about 99.99% is obtained.

5. A process in accordance with claim 1 wherein tellurium of a purity of 99.99% is obtained.

6. A process in accordance with claim 1 wherein arsenic in a purity of 99.99% is obtained.

* * * * *